US012392588B1

(12) United States Patent
Chupp et al.

(10) Patent No.: US 12,392,588 B1
(45) Date of Patent: Aug. 19, 2025

(54) EXPANDING FIN ROCKET WITH FIN RESTRAINT

(71) Applicant: The Government of the United States, as represented by the Secretary of the Air Force, Wright-Patterson AFB, OH (US)

(72) Inventors: Skyler Chupp, Moody AFB, GA (US); Nicholas Hanzlik, Moody AFB, GA (US)

(73) Assignee: United States of America as represented by the Secretary of the Air Force, Wright-Patterson AFB, OH (US)

( * ) Notice: Subject to any disclaimer, the term of this patent is extended or adjusted under 35 U.S.C. 154(b) by 0 days.

(21) Appl. No.: 18/435,182

(22) Filed: Apr. 9, 2024

(51) Int. Cl.
*F42B 10/16* (2006.01)

(52) U.S. Cl.
CPC ..... *F42B 10/16* (2013.01)

(58) Field of Classification Search
CPC ..... F42B 10/16
USPC ..... 89/1.812
See application file for complete search history.

(56) References Cited

U.S. PATENT DOCUMENTS

| | | | | |
|---|---|---|---|---|
| 2,809,587 | A | 10/1957 | Musser | |
| 2,996,012 | A | 8/1961 | Butler | |
| 3,769,912 | A | 11/1973 | Friend | |
| 3,903,693 | A | 9/1975 | Fox | |
| 4,109,582 | A | 8/1978 | Haep | |
| 4,699,334 | A * | 10/1987 | Boeder | F42B 10/16 244/3.29 |
| 4,778,127 | A * | 10/1988 | Duchesneau | F42B 10/16 D22/100 |
| 6,371,684 | B2 | 4/2002 | Giesenberg | |
| 6,672,537 | B1 | 1/2004 | Deckard | |
| 6,978,967 | B1 * | 12/2005 | Scheper | F42B 10/16 102/385 |
| 2004/0200375 | A1 * | 10/2004 | Kautzsch | F42B 10/64 102/385 |
| 2005/0145750 | A1 * | 7/2005 | Okada | F42B 10/16 244/3.1 |
| 2011/0315812 | A1 * | 12/2011 | Shin | F42B 10/16 244/49 |
| 2012/0210901 | A1 * | 8/2012 | Bender | F42B 10/16 244/3.29 |
| 2021/0148684 | A1 * | 5/2021 | Laheyne | F42B 15/01 |

* cited by examiner

*Primary Examiner* — Samir Abdosh
(74) *Attorney, Agent, or Firm* — AFMCLO/JAZ; Larry L. Huston

(57) ABSTRACT

An expanding fin aerial rocket in combination with a sleeve for restraining the fins prior to deployment. The rocket has an elongate body with a fore end for a warhead and an opposed aft end for motor and guidance fins. The guidance fins are hingedly attached to the rocket body at a proximal end and extend outwardly to a distal end. Fins may be collapsed during storage to conserve space and prevent damage. The springs are outwardly spring biased for flight upon deployment. The rocket has a durable removable sleeve, which fits over the fins during storage, to retract the sleeves into a collapsed position. The sleeve is removed for deployment, so the fins may radially expend to an extended position. The durable sleeve may then be reused for another rocket.

20 Claims, 11 Drawing Sheets

FIG. 1B2
(PRIOR ART)

FIG. 1B1
(PRIOR ART)

EXPANDING FIN ROCKET WITH FIN RESTRAINT

STATEMENT OF GOVERNMENT INTEREST

The invention described and claimed herein may be manufactured, licensed and used by and for the Government of the United States of America for all government purposes without the payment of any royalty.

FIELD OF THE INVENTION

The present invention is related to expandable fin aerial rockets having expanding fin retaining sleeves and more particularly to such rockets having durable expanding fin retaining sleeves.

BACKGROUND OF THE INVENTION

Unguided air-launched rockets 70 mm diameter were originally developed in the late 1940s by the Naval Ordnance Test Station at China Lake, CA. as an air-to-air weapon to be used by interceptors against heavy bombers. Later modifications provided for air-to-ground use. The original model was the MK 4, which was spin-stabilized and featured four flip-out fins around the nozzle, commonly referred to as a folding fin aerial rocket (FFAR). Fitted with a six pound HE warhead, this rocket was widely used in the 1950s by USAF interceptors as the Mighty Mouse air-to-air rocket. These rockets used as supplements and/or replacements for guns in both air-to-air and air-to-ground applications. Millions of these rockets have been built, and the latest versions are still widely used by all U.S. armed services and several friendly foreign nations.

The current 70 mm rockets are known as Hydra 70 rockets and use the MK 66 rocket motor. The Hydra 70 is a high-explosive (HE), fin-stabilized, un-guided rocket used primarily in the air-to-ground role with various available warheads. The Hydra 70 was developed by the U.S. Army as a replacement of the MK 4 and MK 40 for both fixed-wing aircraft and helicopters.

The three fins are of the wrap-around type, and fit around the circumference of the rocket nozzle. Therefore the MK 66 is sometimes called a WAFAR (Wrap-Around Fin Aerial Rocket) instead of an FFAR. Both the FFAR and WAFAR and described herein as Expanding Fin Aerial Rockets (EFAR).

The MK-66 rocket is part of the Hydra-70 family of rockets made by General Dynamics. This rocket system contains three components: the MK66 MOD 4 rocket motor, one of nine available warheads, and the associated point-detonating, or remote-set fuze(s). The Hydra 70 rocket is 2.75" diameter, 41.7" long without a warhead, weighs 23 to 27 pounds and uses one of three available motors. Average thrush ranges from 1335 lbs. to 1415 lbs. with a 148 ft/sec launch velocity and 60-70 g launch acceleration, rising to 95-100 g at final velocity. The effective range is 500 M to 8000 M with a launch spin rate of 10 rps and a final spin rate of 35 fps. The Hydra 70 fires from the existing seven and 19-tube launchers and can be mounted on most rotary and fixed-wing aircraft. Hydra-70 rockets are fired from the LAU-61 19-tube, M261 19-tube, LAU-68 7-tube and LAU-131/A 7-tube rocket launchers, collectively referred to herein as weapons. The Navy uses the 19 round LAU-61C/A and the seven round LAU-68 D/A rocket launchers. These reusable launchers have an external thermal coating that greatly prolongs cook-off protection time. Full production of these launchers began in June 1985.

The rocket system can be installed on most rotary and fixed-wing aircraft, such as the AH-64 Apache, AH-1Z Viper, AH-1 Cobra, OH-58 Kiowa, UH-60 Black Hawk, P-3 Orion, MH-6 Little Bird, A-10 Thunderbolt II, AV-8B Harrier II, UH-1 Iroquois, F-4 Phantom II, F-16 Fighting Falcon, F/A-18 Hornet, OV-10 Bronco, A-4 Skyhawk and A-6 Intruder. General Dynamics has made more than four million air-launched Hydra 70 rockets since 1996 and the four-millionth Hydra-70 rocket was delivered to the US Army in May 2011.

The Hydra 70 rocket has three aft wraparound fins which fit around the circumference of the rocket body. The fins are spring biased to open upon firing. But these fins must be restrained from opening when the rocket is in storage, transport, not in the launcher or otherwise weaponed. If the fins are opened during storage, the rocket requires more storage space and the fins are subject to damage. Even damage to one fin requires the rocket to be taken out of service and subsequently transported off-site for repair.

Currently the wraparound fins are restrained with single-use adhesive tape during storage. But adhesive tape has a limited lifespan. More particularly, adhesive tape loses efficacy when subjected to heat or humidity. Unfortunately common conditions in austere environments often expose the adhesive tape to heat and/or humidity, causing the tape to lose its efficacy and allowing the fins to spring open. Several tapes have been tried, but none have proven efficacious.

Furthermore, if the tape prematurely releases, the fins open under the spring force exposing a contact band of the rocket motor. The rocket motor is classified as subject to Hazards of Electro-Magnetic Radiation and Electrostatic Discharge unsafe. A spark to the contact band could cause premature ignition of the motor, creating a safety hazard.

Furthermore, even if the tape properly restrains the fins, the tape takes time to apply to and unwind from the rocket. Care is required during winding of the fins to ensure all fins are in proper position, debris from the environment does not block the adhesive and cutting of the tape to length does not scratch sensitive components. Care is also required during tape removal to prevent damage to the rocket, often requiring undue time and potentially delaying operability.

Furthermore, even under the best conditions the tape is single use. The tape has to be replenished leading to ongoing expenses, old tape discarded and new tape ordered as part of the supply regiment—all leading to administrative burdens.

Literally millions of the Hydra 70 rockets were used in Vietnam. Hydra 70 rockets were also deployed in Operation Just Cause and as Desert Storm. Media report the Hydra 70 rockets have been sent to Ukraine for the war against Russia. Despite the millions of EFAR rockets having been used from the 1940's through present day, the problems with restraining expanding fins have persisted for decades. Clearly a new approach is needed.

There is a need for a retaining sleeve which is durable, i.e. not discarded after a single use and which can be restored, if necessary, and cleaned for future use. There is a need for such a sleeve which can be quickly and easily installed to ensure the fins are in proper position and likewise quickly and easily removed for combat readiness. There is a need for a retaining sleeve which can be installed and removed with one hand. There is a need for a retaining sleeve which is not affected by heat, humidity or other climate conditions.

SUMMARY OF THE INVENTION

In one embodiment the invention comprises an elongate, powerable, expanding fin aerial rocket. The rocket comprises: a body having a fore end for containing a warhead and an aft end opposed thereto, the aft end having at least one autonomously radially expandable fin joined thereto, the at least one fin being biased to expand outwardly from a collapsed position juxtaposed with the body to an extended position outward of the body; and a sleeve removably installed over the at least one fin in the collapsed position, the sleeve restraining the at least one fin in the collapsed position and being removable to allow the at least one fin to expand outwardly from the body, the sleeve having an inner surface oriented towards the body and outer surface opposed thereto, the inner surface of the sleeve being conductive whereby a charge occurring proximate the at least one fin is grounded to prevent ignition of a motor at the aft end of the rocket.

In another embodiment the invention comprises a longitudinally elongate, powered, expanding fin aerial rocket. The rocket comprises: a body having a fore end for containing a warhead and an aft end opposed thereto, the aft end having a plurality of circumferentially spaced, radially expandable fins joined thereto, the plural fins being outwardly spring biased; and a hollow sleeve removably installed over each of the plural fins in a collapsed position, the sleeve restraining the plural fins in the collapsed position and being removable to allow the at least one fin to expanding outwardly from the body, the sleeve having an electrically conductive inner surface oriented towards the body and outer surface opposed thereto, the inner surface of the sleeve being conductive whereby a charge occurring proximate the aft end is grounded to prevent ignition of a motor at the aft end of the rocket.

In another embodiment the invention comprises a method of handling an expanding fin aerial rocket. The method comprises the steps of:

a. providing at a storage location a first longitudinally elongate, powered, expanding fin aerial rocket, the rocket having a body having a fore end for containing a warhead and an aft end opposed thereto, the aft end having a plurality of circumferentially spaced, radially expandable fins joined thereto, the plural fins being outwardly spring biased from a collapsed position proximate the body to a radially extended position and a complementary hollow sleeve having an electrically conductive inner surface oriented towards the body and outer surface opposed thereto, the inner surface of the sleeve being conductive whereby a charge occurring proximate the aft end of the rocket is grounded to prevent ignition of a motor at the aft end of the rocket;
b. removably installing the sleeve over each of the plural fins in the collapsed position, the sleeve restraining the plural fins in the collapsed position and being removable therefrom without damage to the fins;
c. transporting the rocket to a deployment location;
d. removing the sleeve from the plural fins; and
e. loading the rocket onto a weapon without undue delay.

BRIEF DESCRIPTION OF THE DRAWINGS

FIG. 1B1 is an enlarged view of the fins and nozzle assembly of the aerial rocket of FIG. 1B according to the prior art.

FIG. 1B2 is an enlarged view of the fins of FIG. 1B1 in a collapsed position according to the prior art.

FIG. 2 is a schematic perspective view of a sleeve according to the present invention engaging a fragmentary rocket shown in phantom having a single, retracted fin in the collapsed position.

DETAILED DESCRIPTION OF THE INVENTION

Figure 1A:
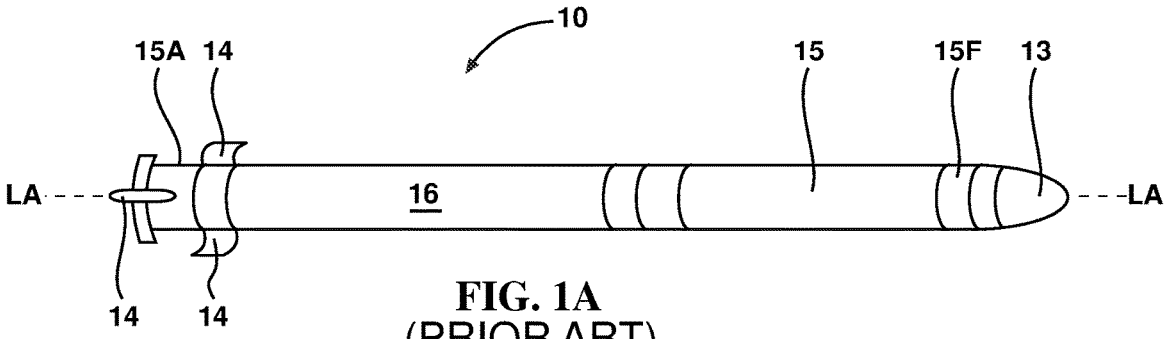
FIG. 1A (PRIOR ART)
FIG. 1A is a perspective view of an expanding fin aerial rocket according to the prior art.
Figure 1B:
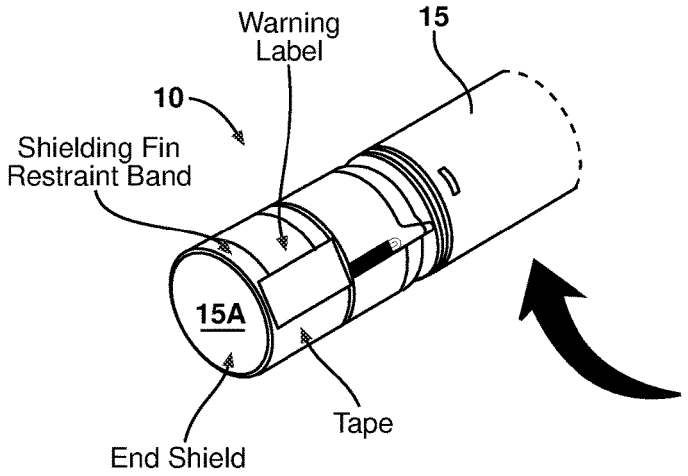
FIG. 1B (PRIOR ART)
FIG. 1B is a partially exploded perspective view of a wraparound fin aerial rocket according to the prior art, having three fins in an open position.
Figure 1B:
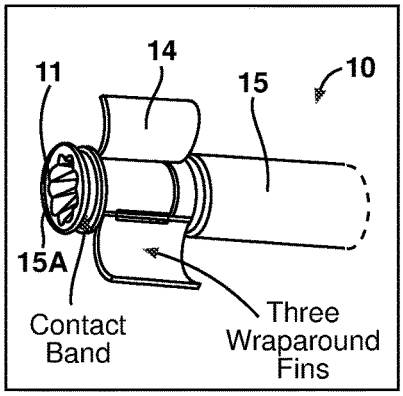
FIG. 1B (PRIOR ART)
Figure 1B:
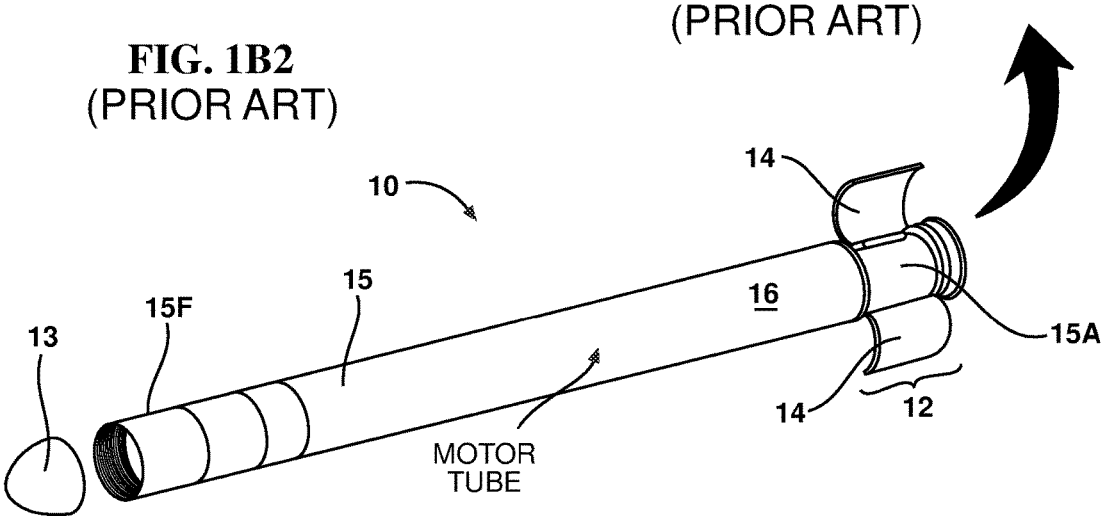
FIG. 1B (PRIOR ART)

Referring to FIG. 1A, FIG. 1B, FIG. 1B1 and FIG. 1B2 a rocket 10 according to the present invention is elongate in a longitudinal direction defined by longitudinal axis LA. The rocket 10 has a body 15 with an exterior surface 16 and may be axi-symmetrical about longitudinal axis LA. The rocket 10 has a fore end 15F for optionally holding a removable warhead 13 and an aft end 15A longitudinally opposed thereto. The rocket 10 has a motor 11 at the aft end 15A and typically comprising one or more slanted nozzles. At least one outwardly biased fin 14 extends juxtaposed with the aft end 15A of the body 15 extends outwardly from the exterior surface 16. The aft end 15A of the rocket 10 has a fin 14 and nozzle assembly 12 providing for propulsion and trajectory.

Figure 1C:
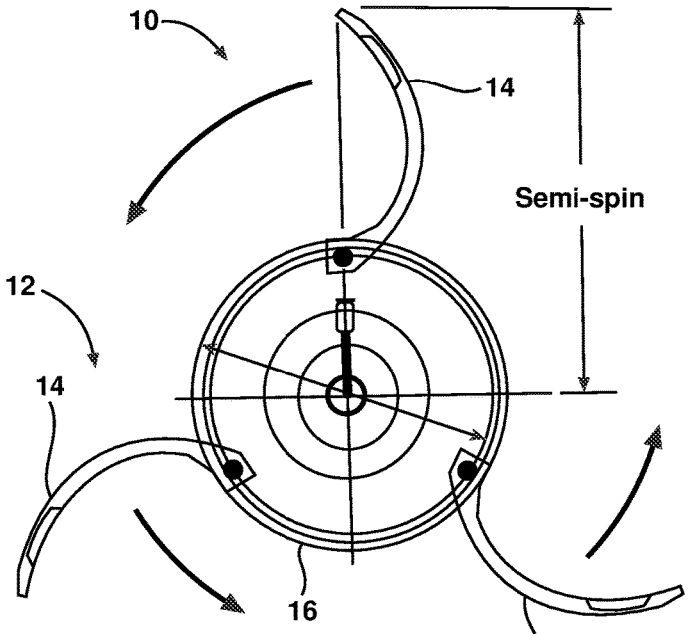
FIG. 1C (PRIOR ART)
FIG. 1C is a rear profile view of the rocket of FIG. 1B according to the prior art and having wraparound fins in an extended position.

Referring to FIG. 1C, the fins 14 extend from a proximal end and may be hingedly joined thereat to the body 15 of the rocket 10. The fins 14 extend to a distal end remote from the respective proximal end. The fins 14 may be plural and substantially circumscribed the body 15 in a first, collapsed position in which the fins 14 are retracted and proximate the exterior surface 16. The fins 14 may be circumferentially conforming wraparound fins 14 retracting in the direction of the arrows to the collapsed position.

Figure 1D:
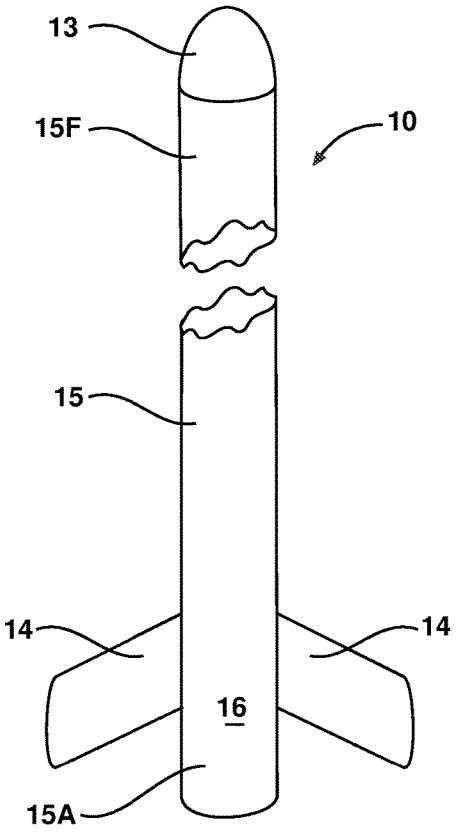
FIG. 1D (PRIOR ART)
FIG. 1D is a side elevational view of an indeterminate length expanding fin aerial rocket according to the prior art.

Referring to FIG. 1D, the rocket 10 may have one or more folding fins 14 which extend in the direction of the arrows to, a second, open position. Such fins 14 articulate in the longitudinal direction and may be hingedly attacked to the exterior of the body 15 at the proximal end of the fins. The rocket 10 forms no part of the claimed invention, except as specifically claimed herein in combination with a sleeve.

Figure 2:
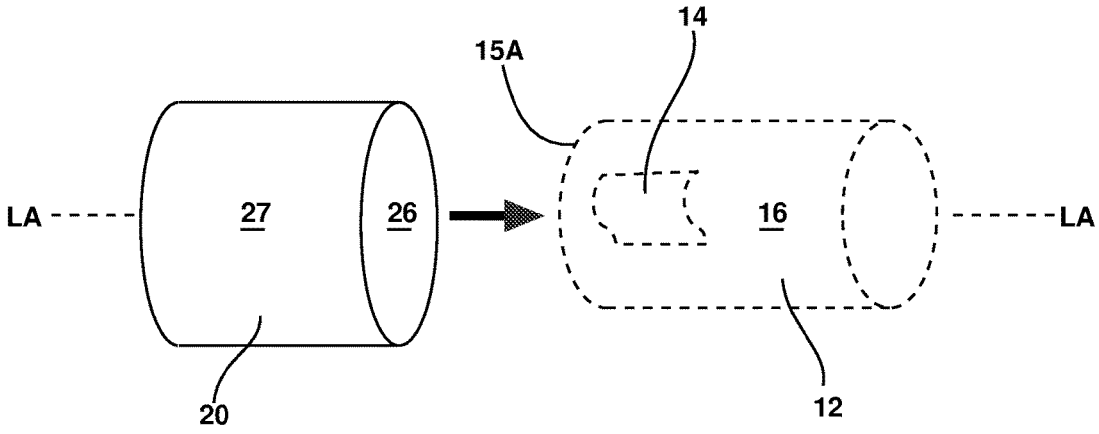

Referring to FIG. 2, a sleeve 20 according to the present invention is longitudinally elongate and preferably axisymmetric about longitudinal axis LA. The sleeve 20 has longitudinally opposed ends which may be open and perpendicular to longitudinal axis LA. The sleeve 20 telescopingly fits over the aft end 15A of the rocket 10 in the axial direction as inserted in the direction of the arrow. The sleeve 20 may have a light friction fit, as imparted by the outward spring bias of the fins. The sleeve 20 is preferably concentric to both the body 15 and to the longitudinal axis LA when installed on the rocket 10.

The rocket 10 may be stored in a first location for protection from weather, sabotage, etc. The sleeve 20 is installed on the rocket 10 in the first location. The rocket 10 is later transported to a second location for deployment and loading onto one of the aforementioned weapons. A rocket 10 may be moved individually or moved in a plurality of rockets 10 to be deployed on a common weapon or different weapons. The sleeve 20 is removed form each rocket 10 at the second location.

Figure 3A:
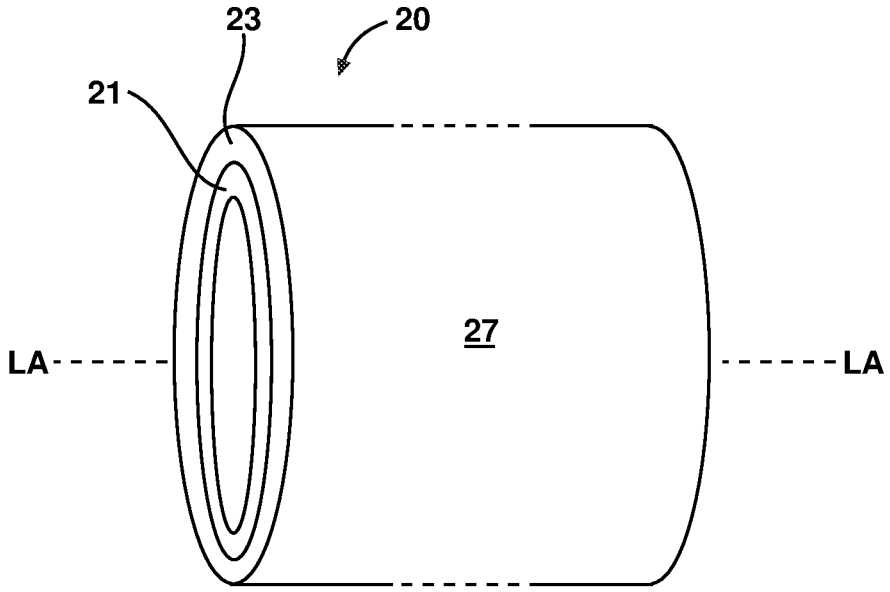
FIG. 3A is a perspective view of an indeterminate length sleeve according to the present invention.
Figure 3B:
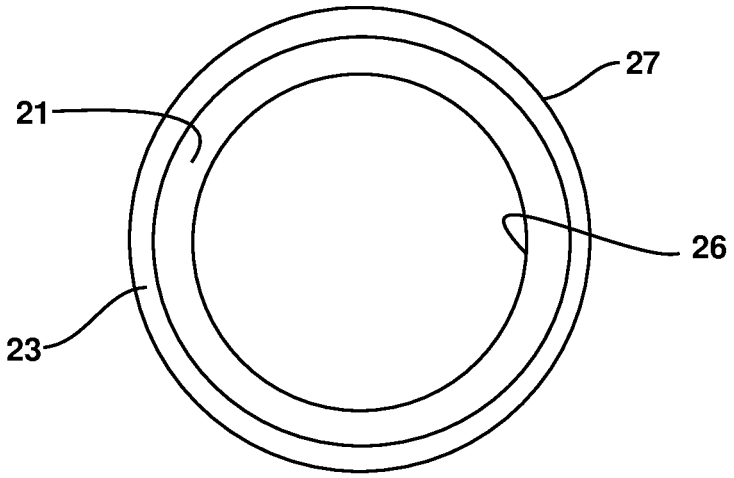
FIG. 3B is an end view of a sleeve according to the present invention.

Referring to FIG. 3A and FIG. 3B, the sleeve 20 may be generally cylindrical and have a round cross section. The sleeve 20 preferably comprises an inner ring 21 and an outer ring 23 joined in face to face relationship. The inner ring 21 has an inner surface 26 which faces towards longitudinal axis LA and contacts the fins 14 in the collapsed position. The inner surface 26 is preferably smooth and continuous, to minimize obstructions, rugosities or other snags when telescopingly installing or removing the sleeve. The inner ring 21 may be electrically conductive to ground any spark which occurs while installed on the rocket 10. The inner surface 26 may comprise any electrically conductive material, such as aluminum foil, printed metal, steel linings, etc.

The outer ring 23 may comprise any material having sufficient hoop strength to resist the combined spring bias of all of the fins. The outer ring 23 may be metallic or is preferably polymeric. The inner ring 21 and outer ring 23 may be adhesively joined, joined by spin welding, etc. Preferably the inner ring 21 and the outer ring 23 are not axially rotatable relative to the other, although the entire sleeve 20 may be axially rotatable relative to the exterior surface 16 of the body 15 of the rocket 10. In one nonlimiting embodiment, the sleeve 20 may be an open cylinder which is 4 inches long with a 2.9" ID. The longitudinal length of the sleeve 20 may be less than, equal to or preferably slightly greater than the axial length of the fins, so that the fins 14 are protected by the sleeve 20 when installed on the rocket 10. The sleeve 20 may be rigid, not plastically deforming during ordinary use and storage. A rigid sleeve 20 provides the benefit, not found in the prior art, that such sleeve 20 can readily be installed and removed with one hand. Furthermore, the rigid sleeve 20 of the present invention can ambidextrously be installed or removed using either hand.

Figure 4A:
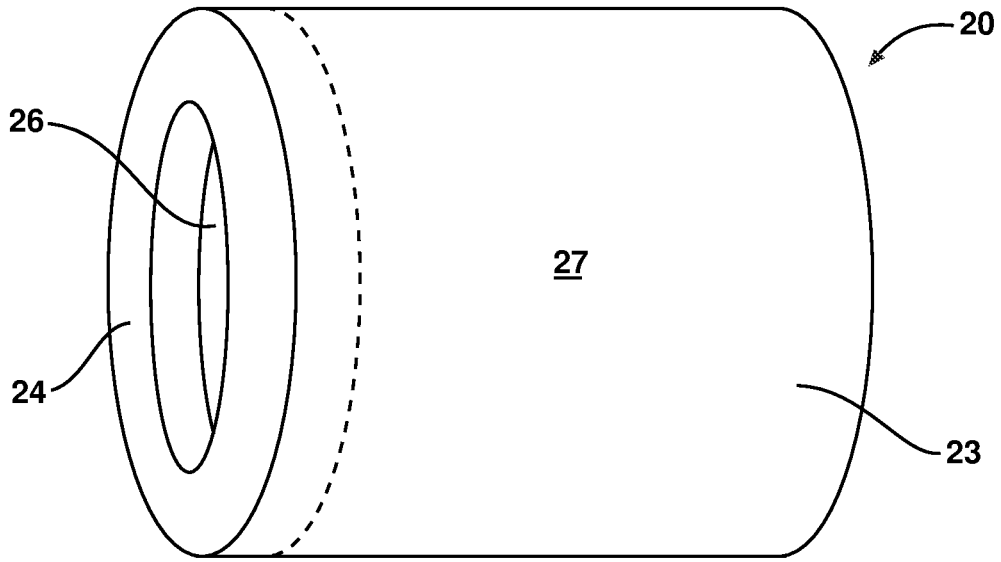
FIG. 4A is a perspective view of an alternative embodiment of a sleeve according to the present invention.
Figure 4B:
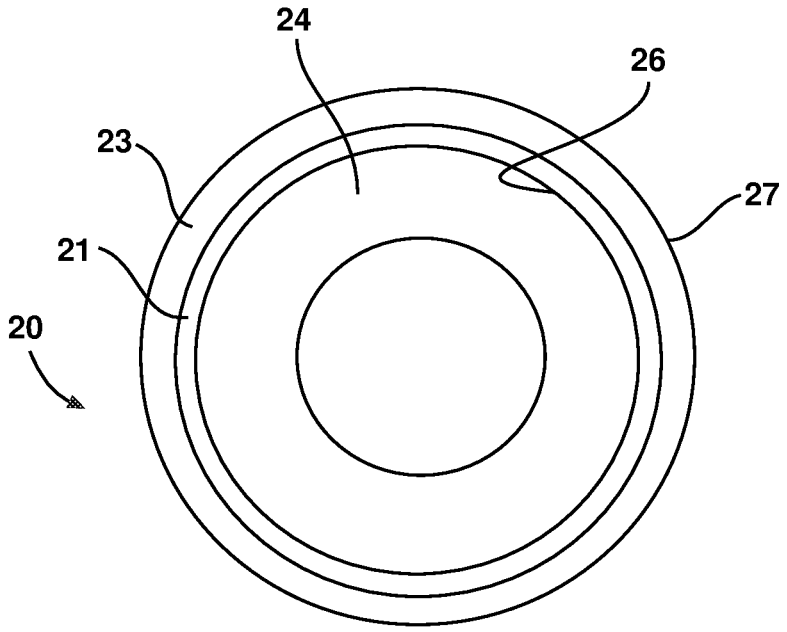
FIG. 4B is an end view of the sleeve of FIG. 4A.

Referring to FIG. 4A and FIG. 4B, in one nonlimiting embodiment the sleeve 20 may have a lip 24 at one end thereof. The lip 24 may preferably circumscribe the circumference of the sleeve, or be intermittent. The lip 24 prevents the sleeve 20 from being longitudinally telescoped too far onto the body 15 and ensures the sleeve 20 will be in the right position to hold the fins 14 in collapsed position.

Figure 5:
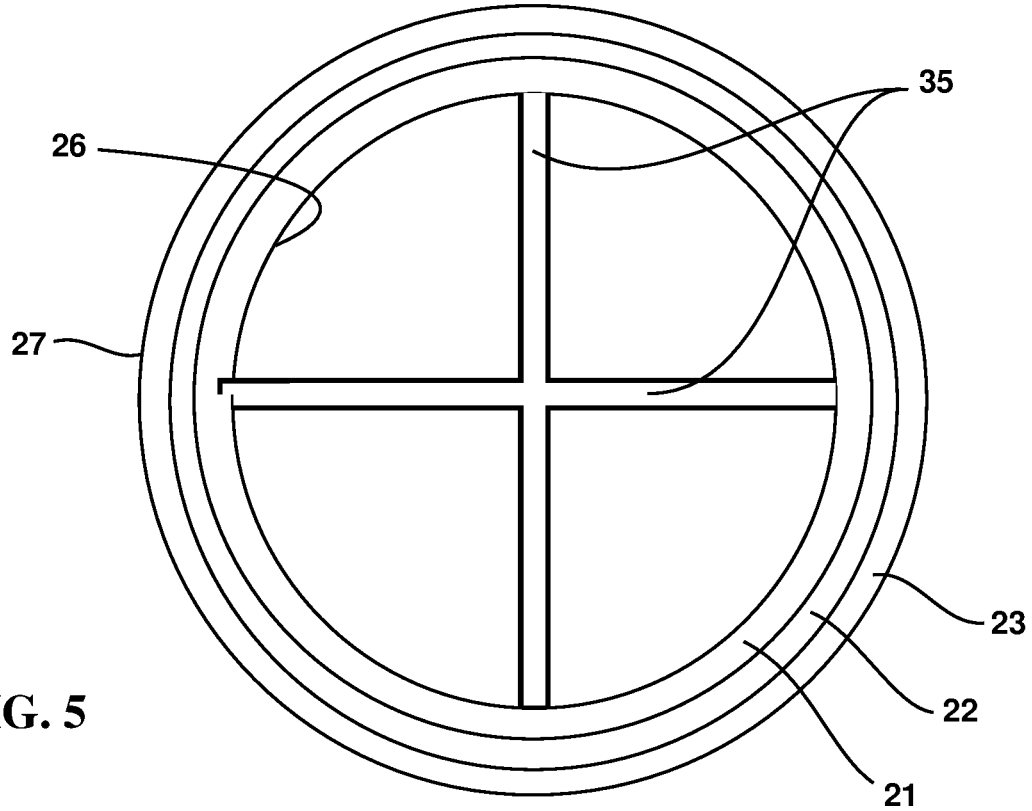
FIG. 5 is an end view of an alternative embodiment of a three ring sleeve having struts.

Referring to FIG. 5, the sleeve 20 may have a third, intermediate ring 22 between and joined to both the inner ring 21 and the outer ring 23. The intermediate ring 22 may be configured to provide hoop strength while the outer ring 23 may provide protection against foreign object damage. The intermediate ring 22 may be continuous and match the respective walls of the circumjacent inner ring 21 and circumjacent outer ring 23. Alternatively, the intermediate ring 22 may be discontinuous to conserve material.

With continuing reference to FIG. 5, one end of the sleeve 20 may have one or more struts 35 thereacross four being shown in a nonlimiting embodiment. The struts 35 form chords and intercept the longitudinal axis LA. While cross struts 35 are shown, one of skill will recognize the invention is not so limited and may comprise a simple diametrical strut, a triskelion, etc. The struts 35 perform a function similar to the aforementioned lip 24, but provide the benefit of increasing both crush strength and hoop tension strength proximate that end.

Figure 6:
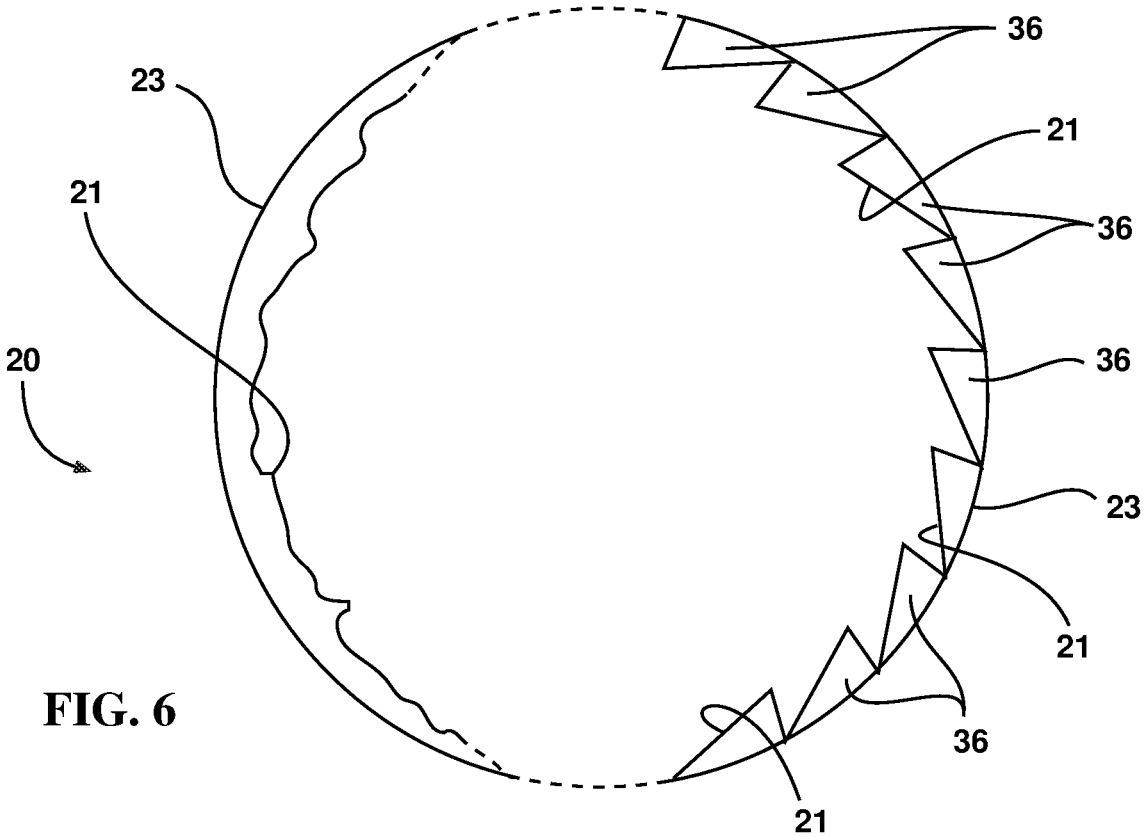
FIG. 6 is a split end view of an alternative embodiment of an indeterminate circumference sleeve having pleats and/or flaccid material for the inner ring.

Referring to the left side of FIG. 6, the inner ring 21 may comprise flaccid material. This arrangement provides the benefit of widening the material selection for the inner ring 21 and particularly providing a material for the inner ring 21 which may cushion the fins 14 to prevent damage during storage and transport. Such an inner ring 21 can accommodate deviations from concentricity in the aft end 15A of the rocket 10.

Referring to the right side of FIG. 6, the inner ring 21 may comprise pleats 36. The pleats 36 provide for accumulation of the otherwise flaccid material into a repeating pattern and thereby reducing snagging during installation and removal. The pleats 36 likewise provide for cushioning against the fins 14. Such an inner ring 21 can accommodate deviations from concentricity in the aft end 15A of the rocket 10.

Figure 7:
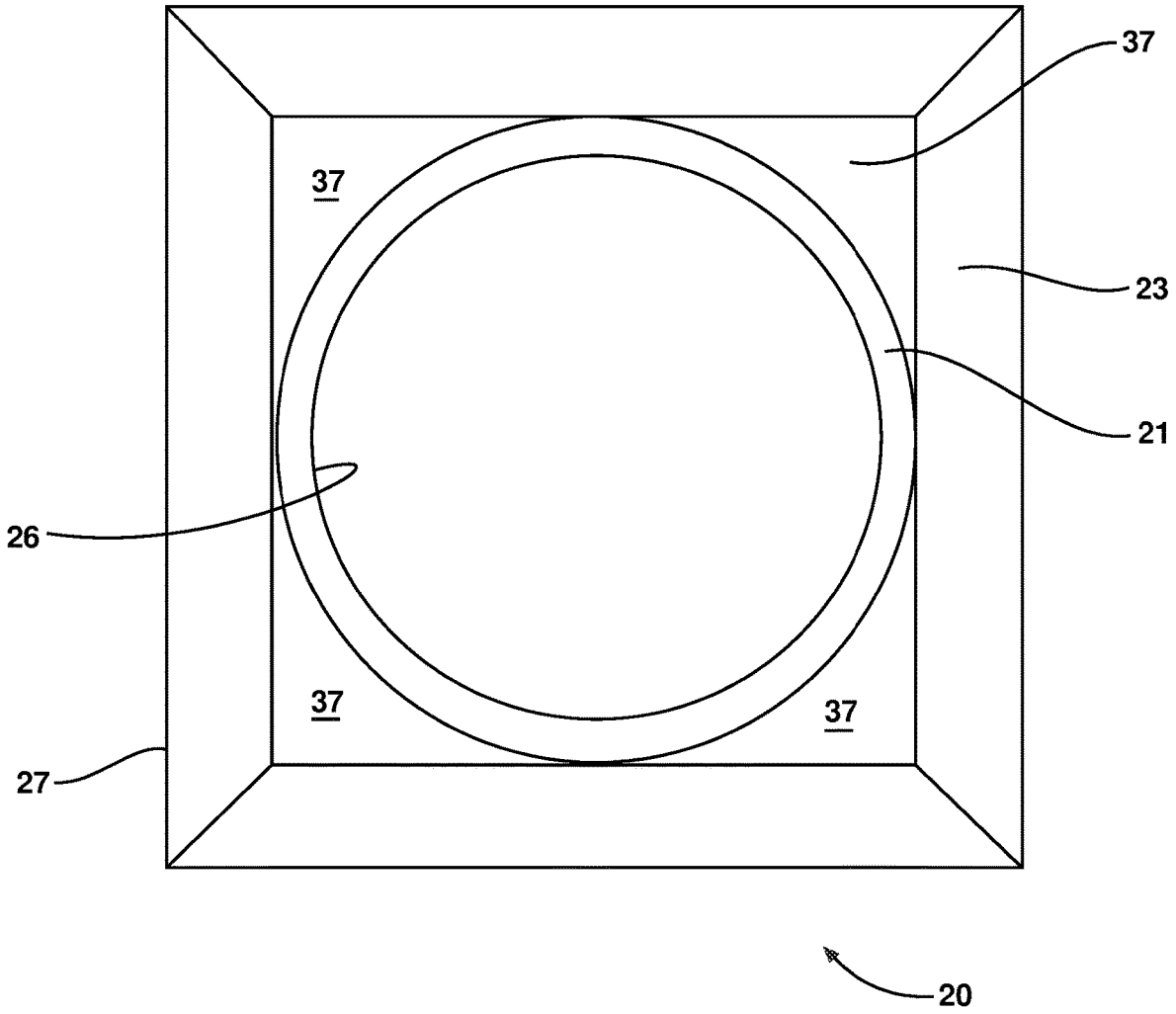
FIG. 7 is an end view of an alternative embodiment of a sleeve having a polygonal outer ring.

Referring to FIG. 7, the outer ring 23 may be polygonal. By polygonal it is meant that the respective inner ring 21 or outer ring 23 forms a regular or irregular polygon having vertices. This embodiment provides the benefit that the sleeve 20 prevents rolling of the rocket 10 during storage. This embodiment provides the further benefit that pockets 37 are formed between the inner ring 21 and the outer ring 23. The pockets 37 can be open ended or closed ends. The pockets 37 may be used for temporary storage of items related to storage and deployment of the rocket 10, padded throughout with foam for cushioning or simply left empty.

Figure 8:
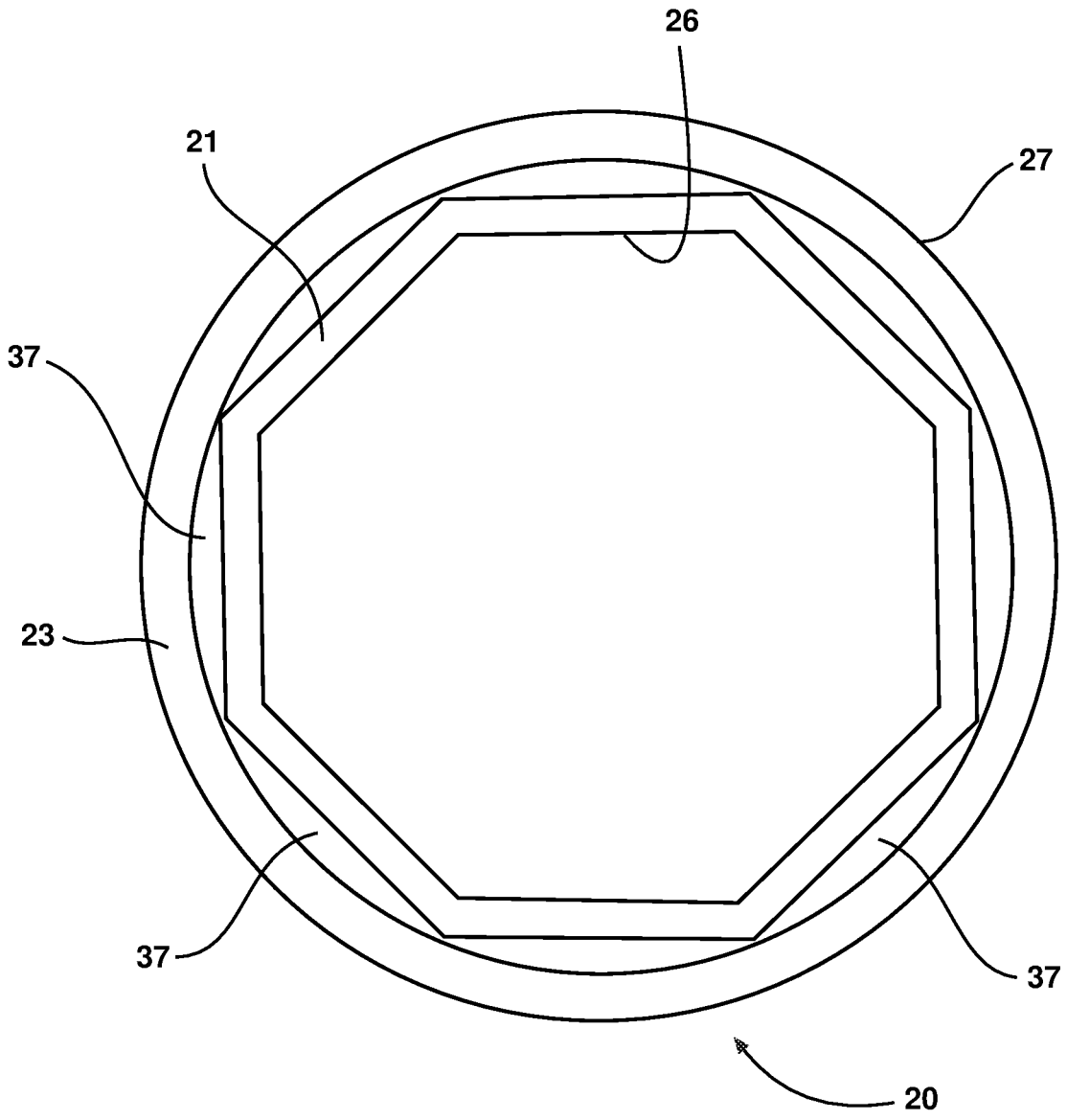
FIG. 8 is an end view of an alternative embodiment of a sleeve having a polygonal inner ring.

Referring to FIG. 8, the inner ring 21 may be polygonal, and pockets 37 formed between the inner ring 21 and the outer ring 23 as discussed relative to the preceding embodiment. The polygonal inner ring 21 provides opposed flat surfaces as may be helpful for folding wing rockets 10 or any rocket 10 having even numbers of opposed outwardly biased fins.

Figure 9:
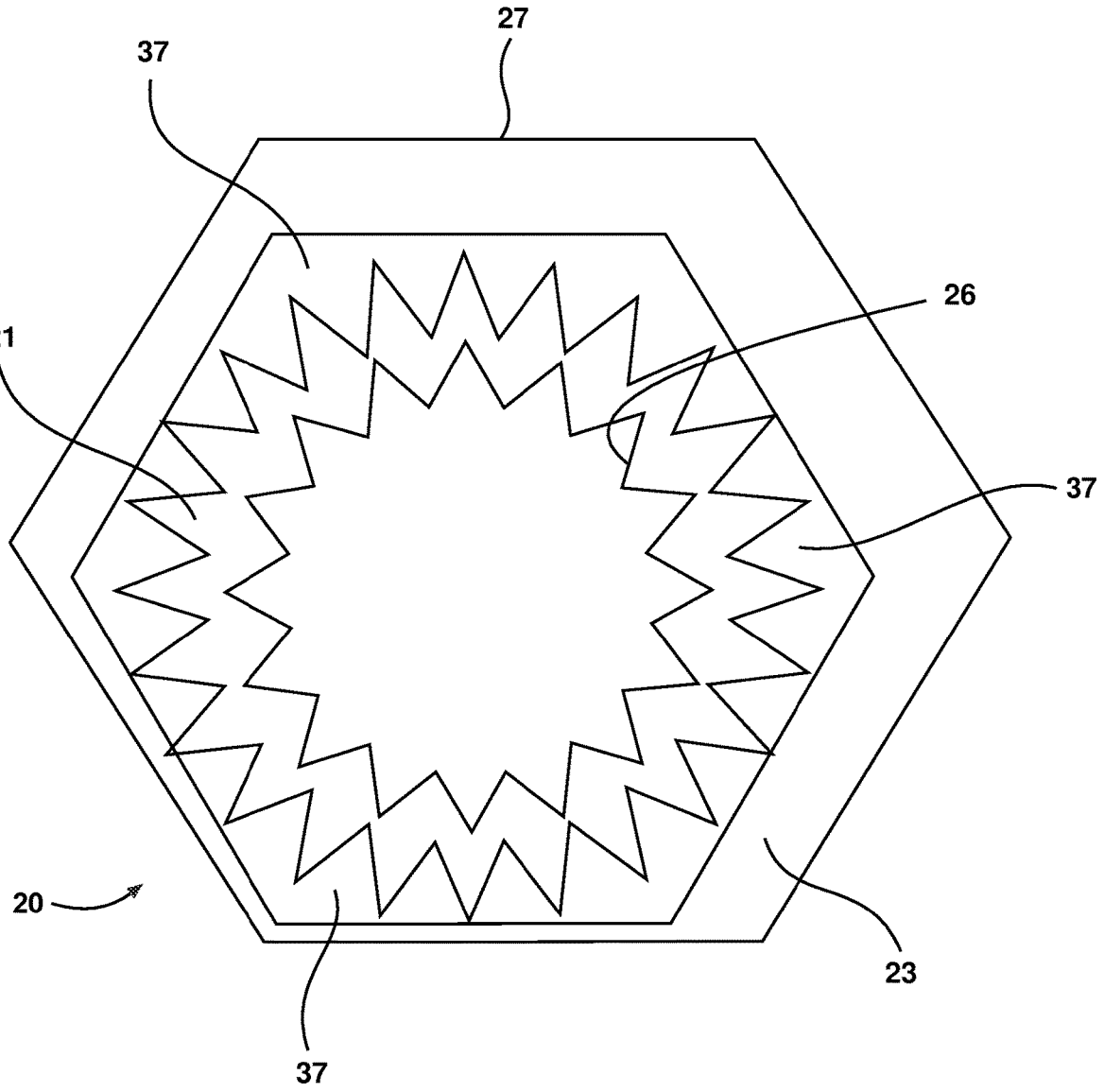
FIG. 9 is an end view of an eccentric alternative embodiment of a sleeve having a polygonal inner ring and polygonal outer ring.

Referring to FIG. 9, in another embodiment, both the inner ring 21 and outer ring 23 may be polymeric and form the aforementioned pockets 37 therebetween. The inner ring 21 and the outer ring 23 in this embodiment, or any of the embodiments described herein, may be eccentric relative to the longitudinal axis. This arrangement provides the benefit that plural rockets 10 with sleeves 20 installed thereon may be conveniently stacked and disposed as irregular storage space allows in austere environments.

Figure 10:
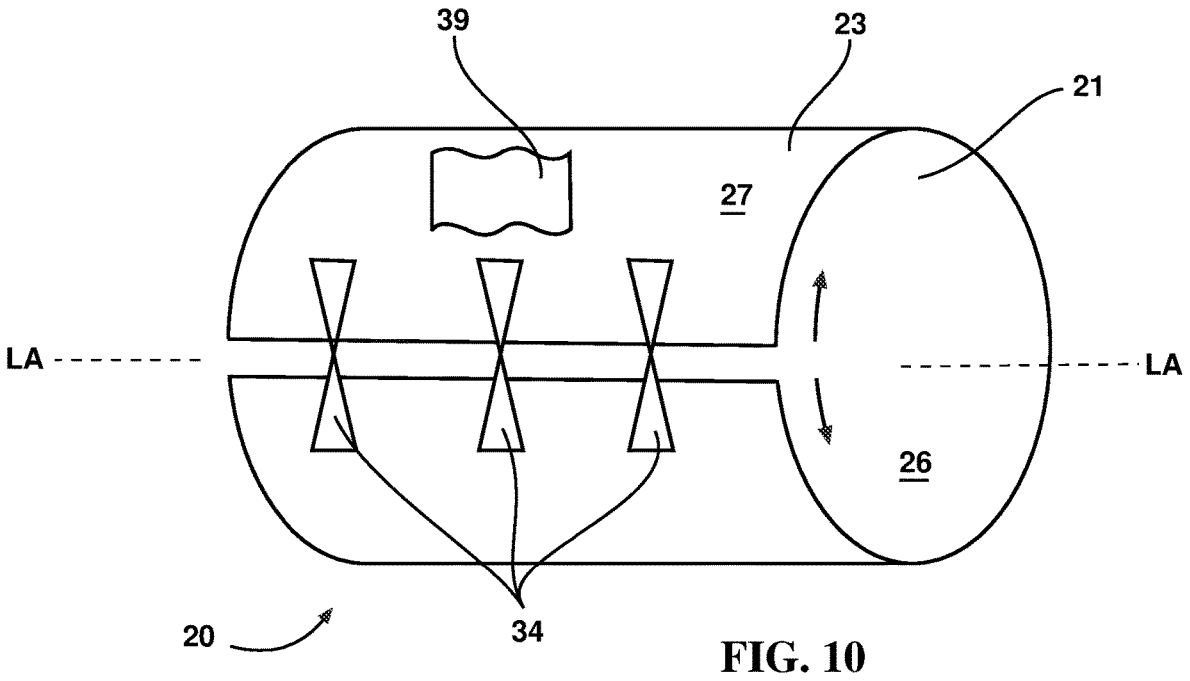
FIG. 10 is a perspective view of an alternative embodiment of a sleeve having latches and indicia.

Referring to FIG. 10, in another embodiment the sleeve 20 may be longitudinally split. The sleeve 20 may be opened in the direction of the arrows for installation onto and removal from the rocket 10. The sleeve 20 may be circumferentially closed about the aft end 15A of the rocket 10 and the outwardly biased fins 14 by latches 34. Suitable latches 34 include buckles, hook and loop fasteners, straps which circumscribe the sleeve, etc. If desired, the sleeve 20 may have a hinge, not shown, diametrically opposite the longitudinal split. This embodiment provides the benefit that if there is insufficient space to longitudinally telescope the sleeve 20 onto and off of the rocket 10, the sleeve 20 may instead be installed and removed in the radial direction.

With continuing reference to FIG. 10, the sleeve 20 may have one or more indicia 39. The indicia 39 may be disposed on the outer surface 27 of the sleeve 20 and provide instructions for use, inventory data, etc.

Figure 11:
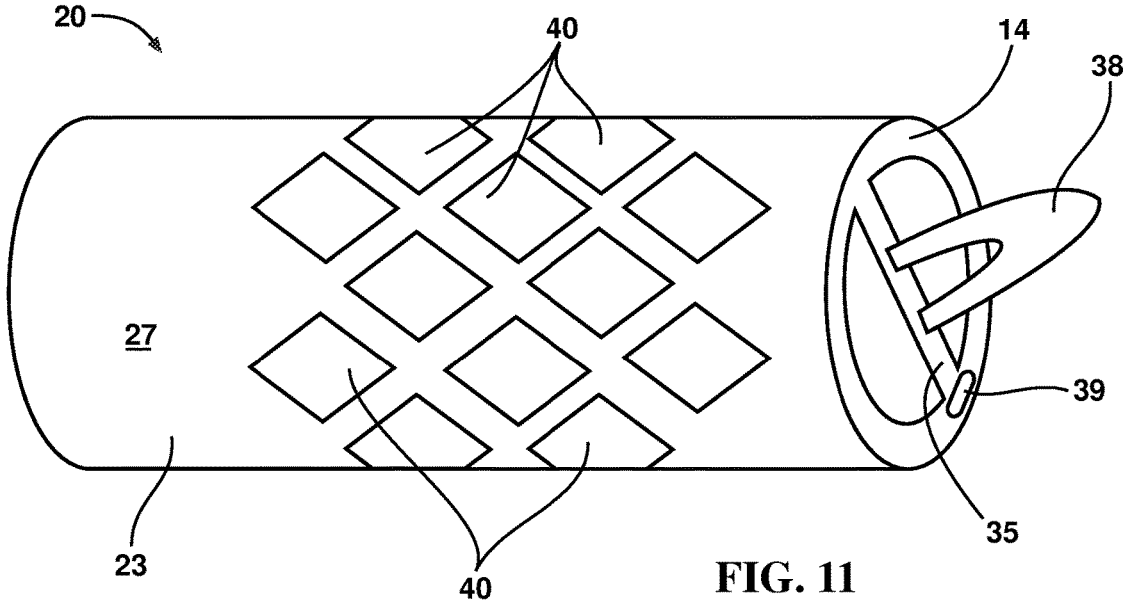
FIG. 11 is a perspective view of an alternative embodiment of a perforate sleeve having a mesh construction and an end cap with a lip, strut and handle.

Referring to FIG. 11, if desired, the sleeve 20 may have a mesh configuration with perforations 40 through the inner ring 21, the outer ring 23 or both. The perforations 40 provide for material conservation, while the continuous mesh retains the necessary hoop strength. The sleeve 20 may have a handle 38 to provide for ergonomics when installing and removing the sleeve. This embodiment provides the benefits of weight reduction and temperature equalization through the sleeve, reducing elevated temperatures therein.

Figure 12:
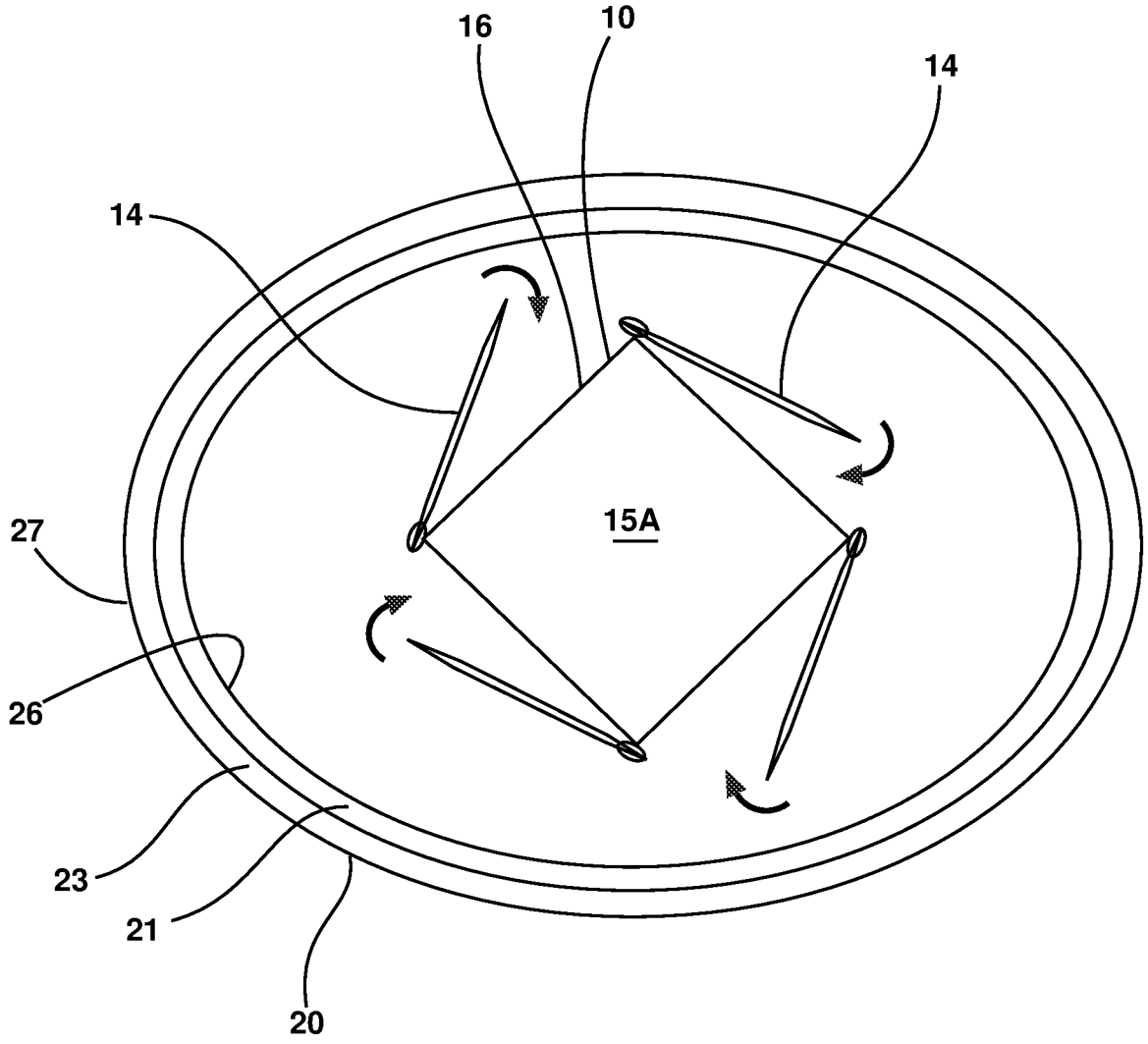
FIG. 12 is an end view of a four wraparound fin, polygonal body rocket having an elastic sleeve therearound.

Referring to FIG. 12, if desired the sleeve 20 may be radially elastic. The sleeve 20 may be stretched open for installation and removal. Upon installation the sleeve 20 elastically contracts, restraining the sleeve 20 about the fins 14 in the collapsed position. This arrangement provides the benefit that a single sleeve 20 may be used for multiple rocket 10 configurations.

Figure 13A:
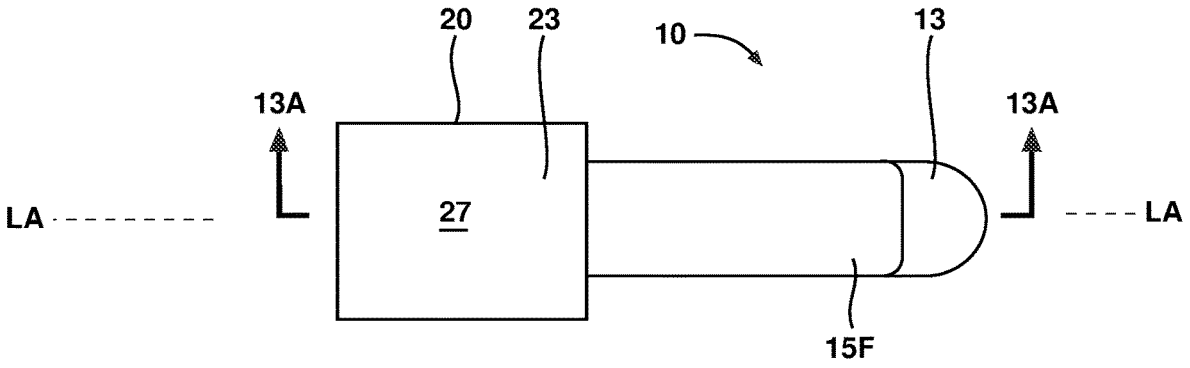
FIG. 13A is a rocket according to the present invention having the sleeve installed on the aft end.
Figure 13B:
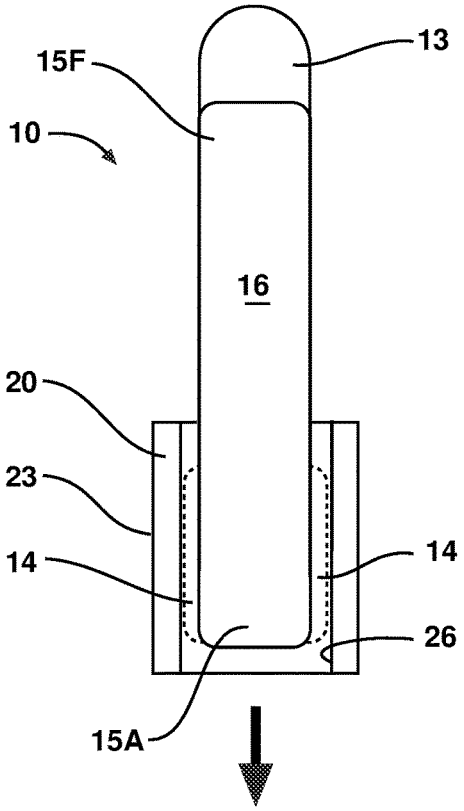
FIG. 13B is a sectional view taken along lines 13A-13A of FIG. 13A, with the fins shown in phantom.

Referring to FIG. 13A and FIG. 13B, in use the sleeve 20 is inserted over the rocket 10 retracting and holding the fins 14 in the collapsed position. The rocket 10 with the installed sleeve 20 therein may be disposed at a first, storage location. The sleeve 20 may be longitudinally removed in the direction of the arrow.

Figure 13C:
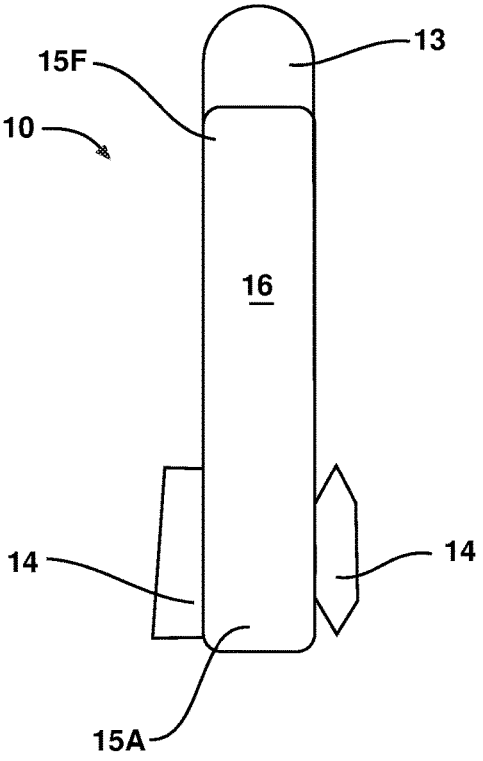
FIG. 13C is a vertical profile view of the asymmetrical rocket of FIG. 13A having the sleeve removed.

Referring to FIG. 13C, the rocket 10 may be transported to a second, deployment location, where the sleeve 20 is removed. Upon removal of the sleeve, the fins 14 extend outwardly for guidance during flight. Advantageously, the sleeve 20 and rocket 10 combination of the claimed invention is feasible for rockets 10 having identical fins 14 or fins 14 of different geometries, as shown. The find may be folding, wraparound or a combination thereof.

Upon removal the durable sleeve 20 is cleaned and inspected as necessary. The sleeve 20 is transported to the original storage location or to a different storage location. The sleeve 20 is then reused as needed on another rocket 10.

All values disclosed herein are not strictly limited to the exact numerical values recited. Unless otherwise specified, each such dimension is intended to mean both the recited value and a functionally equivalent range surrounding that value. For example, a dimension disclosed as "40 mm" is intended to mean "about 40 mm." The term "or" as used herein is to be interpreted as an inclusive or meaning any one or any combination. Therefore, "A, B or C" means "any of the following: A; B; C; A and B; A and C; B and C; A, B and C." Every document cited herein, including any cross referenced or related patent or application, is hereby incorporated herein by reference in its entirety unless expressly excluded or otherwise limited. The citation of any document or commercially available component is not an admission that such document or component is prior art with respect to any invention disclosed or claimed herein or that alone, or in any combination with any other document or component, teaches, suggests or discloses any such invention. Further, to the extent that any meaning or definition of a term in this document conflicts with any meaning or definition of the same term in a document incorporated by reference, the meaning or definition assigned to that term in this document shall govern according to Phillips v. AWH Corp., 415 F.3d 1303 (Fed. Cir. 2005). All limits shown herein as defining a range may be used with any other limit defining a range of that same parameter. That is the upper limit of one range may be used with the lower limit of another range for the same parameter, and vice versa. As used herein, when two components are joined or connected the components may be interchangeably contiguously joined together or connected with an intervening element therebetween. A component joined to the distal end of another component may be juxtaposed with or joined at the distal end thereof. While particular embodiments of the present invention have been illustrated and described, it would be obvious to those skilled in the art that various other changes and modifications can be made without departing from the spirit and scope of the invention and that various embodiments described herein may be used in any combination or combinations. It is therefore intended the appended claims cover all such changes and modifications that are within the scope of this invention.

What is claimed is:

1. An elongate, powerable, expanding fin aerial rocket comprising:

a body having a fore end for containing a warhead and an aft end opposed thereto, the aft end having at least one autonomously radially expandable fin joined thereto, the at least one fin being biased to expand outwardly from a collapsed position juxtaposed with the body to an extended position outward of the body; and a sleeve removably installed over the at least one fin in the collapsed position, the sleeve restraining the at least one fin in the collapsed position and being removable to allow the at least one fin to expand outwardly from the body, the sleeve having an inner surface oriented towards the body and outer surface opposed thereto, the inner surface of the sleeve being conductive whereby a charge occurring proximate the at least one fin is grounded to prevent ignition of a motor at the aft end of the rocket.

2. A rocket according to claim 1 wherein the sleeve is rigid.

3. A rocket according to claim 2 wherein the sleeve has an inner layer comprising a conductive metal film and a polymeric outer layer in contacting relationship with the inner layer.

4. A rocket according to claim 3 wherein the conductive metal film comprises aluminum foil and is joined to the outer layer.

5. A rocket according to claim 4 wherein the sleeve is generally cylindrical.

6. A longitudinally elongate, powered, expanding fin aerial rocket comprising:

a body having a fore end for containing a warhead and an aft end opposed thereto, the aft end having a plurality of circumferentially spaced, radially expandable fins joined thereto, the plural fins being outwardly spring biased; and a hollow sleeve removably installed over each of the plural fins in a collapsed position, the sleeve restraining the plural fins in the collapsed position and being removable to allow the at least one fin to expanding outwardly from the body, the sleeve having an electrically conductive inner surface oriented towards the body and outer surface opposed thereto, the inner surface of the sleeve being conductive whereby a charge occurring proximate the aft end is grounded to prevent ignition of a motor at the aft end of the rocket.

7. A rocket according to claim 6 wherein the hollow sleeve comprises a conductive inner layer and a rigid nonconductive outer layer joined thereto in face to face relationship.

8. A rocket according to claim 7 wherein the hollow sleeve has a friction fit when installed on the aft end of the body and over the fins.

9. A rocket according to claim 8 wherein the hollow sleeve is longitudinally removable from the aft end of the rocket.

10. A rocket according to claim 8 wherein the hollow sleeve is longitudinally split and circumferentially closes around the aft end of the rocket with at least one latch.

11. A rocket according to claim 8 wherein the hollow sleeve has two opposed open ends and further comprising an end cap on one open end, the end cap limiting longitudinal engagement of the sleeve on the aft end of the rocket.

12. A rocket according to claim 11 wherein the end cap comprises a circumferential lip, the lip having a hole therethrough.

13. A rocket according to claim 9 wherein the outer layer of the sleeve is perforate with first and second opposed open ends and a continuous mesh therebetween.

14. A rocket according to claim 13 wherein the inner layer and outer layer of the sleeve are perforate, the sleeve having perforations therethrough.

15. A rocket according to claim 9 having three wrap-around fins and a rigid sleeve which engages the fins when installed on the aft end of the rocket without touching the body of the rocket.

16. A method of handling an expanding fin aerial rocket, the method comprising the steps of:

a. providing at a storage location a first longitudinally elongate, powered, expanding fin aerial rocket, the rocket having a body having a fore end for containing a warhead and an aft end opposed thereto, the aft end having a plurality of circumferentially spaced, radially expandable fins joined thereto, the plural fins being outwardly spring biased from a collapsed position proximate the body to a radially extended position and a complementary hollow sleeve having an electrically conductive inner surface oriented towards the body and outer surface opposed thereto, the inner surface of the sleeve being conductive whereby a charge occurring proximate the aft end of the rocket is grounded to prevent ignition of a motor at the aft end of the rocket;

b. removably installing the sleeve over each of the plural fins in the collapsed position, the sleeve restraining the plural fins in the collapsed position and being removable therefrom without damage to the fins;

c. transporting the rocket to a deployment location;

d. removing the sleeve from the plural fins; and e. loading the rocket onto a weapon without undue delay.

17. A method according to claim 16 further comprising the step of saving the sleeve for future use on a second rocket, the second rocket having an aft end substantially identical to the aft end of the first rocket.

18. A method according to claim 17 further comprising the step of providing a first plurality of identical rockets and an identical first plurality of complementary sleeves and removably installing each sleeve of the plurality of sleeves on a rocket complementary thereto at the storage location.

19. A method according to claim 18 further comprising the step of transporting a second plurality of rockets having complementary sleeves installed thereon to the deployment location, removing each of the sleeves therefrom and loading each of the rockets of the second plurality of rockets onto a weapon.

20. A method according to claim 19 wherein each rocket of the second plurality of rockets is loaded onto the same weapon.

* * * * *